US008672025B2

(12) United States Patent
Wolf et al.

(10) Patent No.: US 8,672,025 B2
(45) Date of Patent: Mar. 18, 2014

(54) DOWNHOLE DEBRIS REMOVAL TOOL

(75) Inventors: John C. Wolf, Houston, TX (US); George Telfer, Scotland (GB); James Atkins, Scotland (GB)

(73) Assignees: M-I L.L.C., Houston, TX (US); M-I Drilling Fluids U.K. Limited, Aberdeen (GB)

( * ) Notice: Subject to any disclaimer, the term of this patent is extended or adjusted under 35 U.S.C. 154(b) by 491 days.

(21) Appl. No.: 12/934,662

(22) PCT Filed: Mar. 27, 2009

(86) PCT No.: PCT/US2009/038552

§ 371 (c)(1), (2), (4) Date: Sep. 27, 2010

(87) PCT Pub. No.: WO2009/120957

PCT Pub. Date: Oct. 1, 2009

(65) Prior Publication Data

US 2011/0024119 A1 Feb. 3, 2011

Related U.S. Application Data

(60) Provisional application No. 61/040,099, filed on Mar. 27, 2008, provisional application No. 61/163,685, filed on Mar. 26, 2009.

(51) Int. Cl.
*E21B 31/08* (2006.01)

(52) U.S. Cl.
USPC ..... 166/99; 166/66.5; 166/312

(58) Field of Classification Search
USPC ..... 166/66.5, 99, 107, 311, 312
See application file for complete search history.

(56) References Cited

U.S. PATENT DOCUMENTS

| | | | | |
|---|---|---|---|---|
| 2,556,849 | A * | 6/1951 | Nolley et al. | 166/66.5 |
| 2,700,567 | A | 1/1955 | Fortenberry | |
| 3,653,512 | A | 4/1972 | Brown | |
| 3,841,489 | A | 10/1974 | Combest et al. | |

(Continued)

OTHER PUBLICATIONS

Examiner's Report issued in corresponding Canadian Application No. 2,719,792; Dated Jun. 6, 2012 (3 pages).

(Continued)

*Primary Examiner* — William P Neuder
(74) *Attorney, Agent, or Firm* — Osha Liang LLP

(57) ABSTRACT

A downhole debris recovery tool including a ported sub coupled to a debris sub, a suction tube disposed in the debris sub, and an annular jet pump sub disposed in the ported sub and fluidly connected to the suction tube is disclosed. A method of removing debris from a wellbore including the steps of lowering a downhole debris removal tool into the wellbore, the downhole debris removal tool having an annular jet pump sub, a mixing tube, a diffuser, and a suction tube, flowing a fluid through a bore of the annular jet pump sub, jetting the fluid from the annular jet pump sub into the mixing tube, displacing an initially static fluid in the mixing tube through the diffuser, thereby creating a vacuum effect in the suction tube to draw a debris-laden fluid into the downhole debris removal tool, and removing the tool downhole debris removal tool from the wellbore after a predetermined time interval is also disclosed. Further, an isolation valve including a housing, an inner tube disposed coaxially with the housing, and a gate, wherein the gate is configured to selectively close an annular space between the housing and the inner tube is disclosed.

22 Claims, 19 Drawing Sheets

(56) References Cited

U.S. PATENT DOCUMENTS

| | | | | |
|---|---|---|---|---|
| 4,067,810 | A | 1/1978 | Sullivan | |
| 4,193,422 | A * | 3/1980 | Rider | 137/625.49 |
| 4,276,931 | A | 7/1981 | Murray | |
| 5,024,271 | A | 6/1991 | Meihua | |
| 5,176,208 | A | 1/1993 | Lalande et al. | |
| 5,318,128 | A | 6/1994 | Johnson et al. | |
| 6,176,311 | B1 | 1/2001 | Ryan | |
| 6,216,787 | B1 | 4/2001 | Ruttley | |
| 6,276,452 | B1 | 8/2001 | Davis et al. | |
| 6,655,462 | B1 | 12/2003 | Carmichael et al. | |
| 6,902,840 | B2 * | 6/2005 | Blanchet et al. | 429/415 |
| 7,137,449 | B2 | 11/2006 | Silguero | |
| 7,219,724 | B2 | 5/2007 | Theriot, Sr. | |
| 7,472,745 | B2 * | 1/2009 | Lynde et al. | 166/99 |
| 7,513,303 | B2 | 4/2009 | Hern | |
| 7,753,124 | B1 | 7/2010 | Penisson | |
| 7,789,154 | B2 | 9/2010 | Davis | |
| 8,061,428 | B2 * | 11/2011 | Fenton et al. | 166/347 |
| 2006/0011344 | A1 | 1/2006 | Lynde et al. | |
| 2006/0086507 | A1 | 4/2006 | Surjaatmadja et al. | |
| 2007/0272404 | A1 | 11/2007 | Lynde et al. | |
| 2009/0032247 | A1 | 2/2009 | Davis | |
| 2010/0243258 | A1 * | 9/2010 | Fishbeck et al. | 166/311 |
| 2011/0024119 | A1 | 2/2011 | Wolf et al. | |
| 2012/0118571 | A1 | 5/2012 | Zhou | |

OTHER PUBLICATIONS

International Search Report from PCT/US2009/038552 dated Oct. 30, 2009 (2 pages).

Written Opinion from PCT/US2009/038552 dated Oct. 30, 2009 (4 pages).

Notification Concerning Transmittal of International Preliminary Report on Patentability and Written Opinion issued in a corresponding International Patent Application No. PCT/US2009/038552; Dated Oct. 7, 2010 (6 pages).

Office Action issued in corresponding Canadian Application No. 2,719,792; Dated Apr. 10, 2013 (2 pages).

Combined Search and Examination Report issued in British Application No. GB1005076.3; Dated May 14, 2010 (2 pages).

Examination Report issued in Australian Application No. 2010201076; Dated Mar. 10, 2011 (2 pages).

Examination Report issued in Australian Application No. 2010201076; Dated May 31, 2011 (2 pages).

Office Action issued in U.S. Appl. No. 12/412,084; Dated Jan. 3, 2012 (14 pages).

Office Action issued in U.S. Appl. No. 12/412,084; Dated Mar. 7, 2013 (16 pages).

Office Action issued in U.S. Appl. No. 12/412,084; Dated May 6, 2011 (13 pages).

Office Action issued in U.S. Appl. No. 12/412,084; Dated Jun. 26, 2013 (9 pages).

Office Action issued in U.S. Appl. No. 12/412,084; Dated Aug. 2, 2012 (15 pages).

Office Action issued in U.S. Appl. No. 12/412,084; Dated Sep. 24, 2013 (11 pages).

Dictionary definition of "divert", access Mar. 1, 2013 via www.thefreedictionary.com as used in the Office Action issued in U.S. Appl. No. 12/412,084; Dated Mar. 7, 2013 (2 pages).

Dictionary definition of "annular", accessed on Jun. 11, 2013 via thefreedictionary.com as used in the Office Action issued in U.S. Appl. No. 12/412,084; Dated Jun. 26, 2013 (2 pages).

* cited by examiner

DOWNHOLE DEBRIS REMOVAL TOOL

BACKGROUND OF INVENTION

1. Field of the Invention

Embodiments disclosed herein generally relate to a downhole debris retrieval tool for removing debris from a wellbore. Further, embodiments disclosed herein relate to a downhole tool for debris removal with maximum efficiency at a low pump rates.

2. Background Art

A wellbore may be drilled in the earth for various purposes, such as hydrocarbon extraction, geothermal energy, or water. After a wellbore is drilled, the well bore is typically lined with casing. The casing preserves the shape of the well bore as well as provides a sealed conduit for fluid to be transported to the surface.

In general, it is desirable to maintain a clean wellbore to prevent possible complications that may occur from debris in the well bore. For example, accumulation of debris can prevent free movement of tools through the wellbore during operations, as well as possibly interfere with production of hydrocarbons or damage tools. Potential debris includes cuttings produced from the drilling of the wellbore, metallic debris from the various tools and components used in operations, and corrosion of the casing. Smaller debris may be circulated out of the well bore using drilling fluid; however, larger debris is sometimes unable to be circulated out of the well. Also, the well bore geometry may affect the accumulation of debris. In particular, horizontal or otherwise significantly angled portions in a well bore can cause the well bore to be more prone to debris accumulation. Because of this recognized problem, many tools and methods are currently used for cleaning out well bores.

One type of tool known in the art for collecting debris is the junk catcher, sometimes referred to as a junk basket, junk boot, or boot basket, depending on the particular configuration for collecting debris and the particular debris to be collected. The different junk catchers known in the art rely on various mechanisms to capture debris from the well bore. A common link between most junk catchers is that they rely on the movement of fluid in the well bore to capture the sort of debris discussed above. The movement of the fluid may be accomplished by surface pumps or by movement of the string of pipe or tubing to which the junk catcher is connected. Hereinafter, the term "work string" will be used to collectively refer to the string of pipe or tubing and all tools that may be used along with the junk catchers. For describing fluid flow, "uphole" refers to a direction in the well bore that is towards the surface, while "downhole" refers to a direction in the well bore that is towards the distal end of the well bore.

The use of coiled tubing and its ability to circulate fluids is often used to address debris problems once they are recognized. Coiled tubing runs involving cleanout fluids and downhole tools to clean the production tubing are often costly.

Accordingly, there exists a need for a more efficient tool and method for removing debris from a wellbore.

SUMMARY OF INVENTION

In one aspect, embodiments disclosed herein relate to a downhole debris recovery tool including a ported sub coupled to a debris sub, a suction tube disposed in the debris sub, and an annular jet pump sub disposed in the ported sub and fluidly connected to the suction tube.

In another aspect, embodiments disclosed herein relate to a method of removing debris from a wellbore including the steps of lowering a downhole debris removal tool into the wellbore, the downhole debris removal tool having an annular jet pump sub, a mixing tube, a diffuser, and a suction tube, flowing a fluid through a bore of the annular jet pump sub, jetting the fluid from the annular jet pump sub into the mixing tube, displacing an initially static fluid in the mixing tube through the diffuser, thereby creating a vacuum effect in the suction tube to draw a debris-laden fluid into the downhole debris removal tool, and removing the tool downhole debris removal tool from the wellbore after a predetermined time interval.

In yet another aspect, embodiments disclosed herein relate to an isolation valve including a housing, an inner tube disposed coaxially within the housing, and a gate, wherein the gate is configured to selectively close an annular space between the housing and the inner tube.

Other aspects and advantages of the invention will be apparent from the following description and the appended claims.

DETAILED DESCRIPTION

Generally, embodiments of the present disclosure relate to a downhole tool for removing debris from a wellbore. More specifically, embodiments disclosed herein relate to a downhole debris removal tool that includes an annular jet pump. Further, certain embodiments disclosed herein relate to a downhole tool for debris removal with maximum efficiency at a low pump rates.

A downhole debris removal tool, in accordance with embodiments disclosed herein, includes a jet pump device. Generally, a jet pump is a fluid device used to move a volume of fluid. The volume of fluid is moved by means of a suction tube, a high pressure jet, a mixing tube, and a diffuser. The high pressure jet injects fluid into the mixing tube, displacing the fluid that was originally static in the mixing tube. This displacement of fluid due to the high pressure jet imparting momentum to the fluid causes suction at the end of the suction tube. The high pressure jet and the entrained fluid mix in the mixing tube and exit through the diffuser.

Figure 1A:
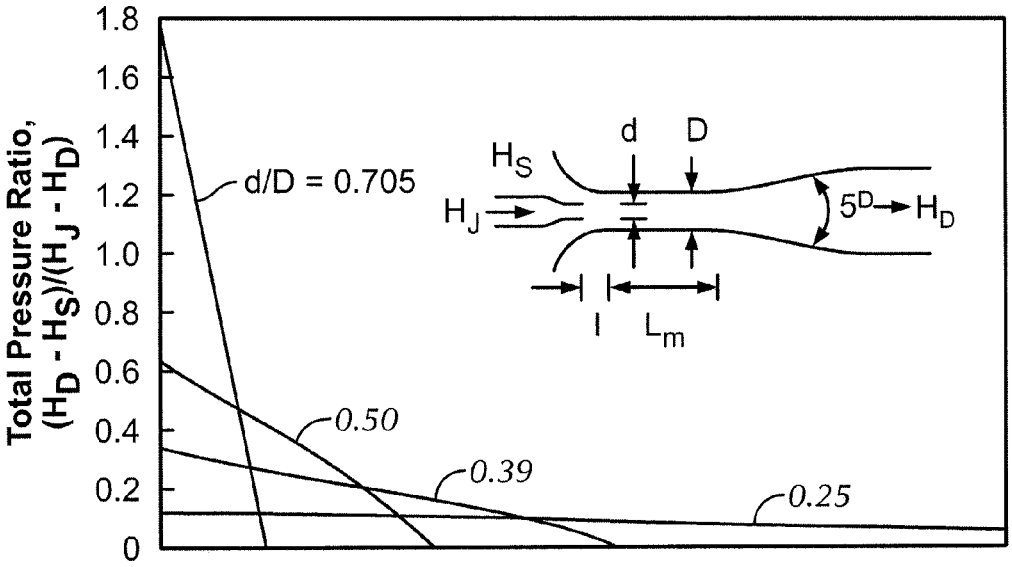
FIGS. 1A and 1B show plots of jet pump operations and equations.
Figure 1B:
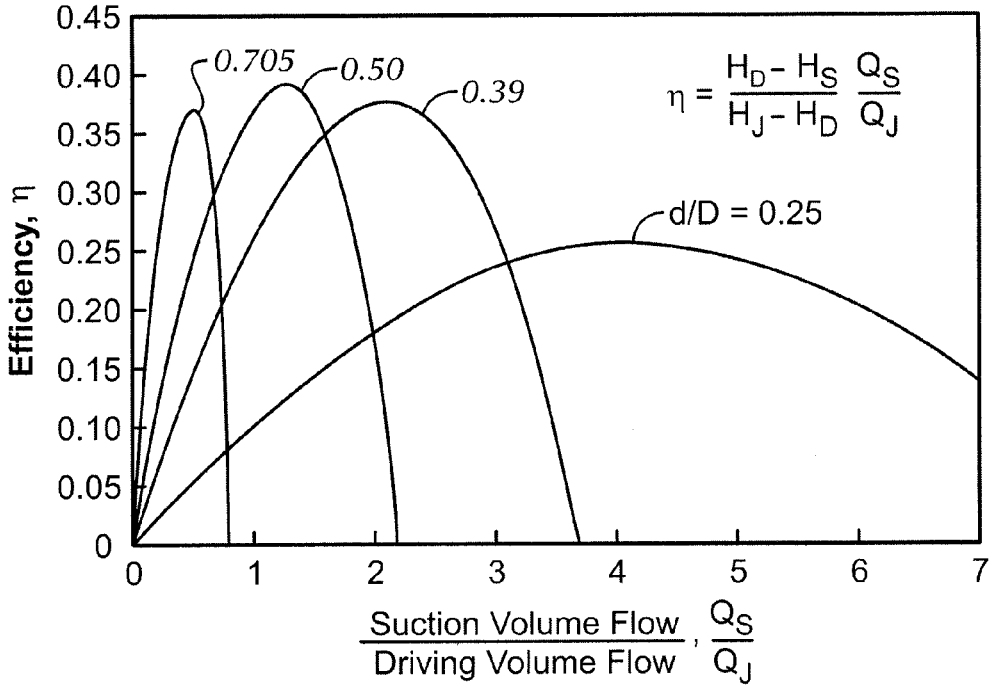

Basic principles of jet pump operation may generally be explained by Equation 1 below, with reference to FIGS. 1A and 1B.

$$\text{Jet Pump Efficiency}=(H_D-H_S/H_J-H_D)(Q_S/Q_J) \quad (1)$$

where $H_D$ is discharge head, $H_S$ is suction head, $H_J$ is jet head, $Q_S$ is suction volume flow, and $Q_J$ is driving volume flow. In accordance with certain embodiments of the present disclosure, for maximum jet pump efficiency, an inlet of the annular jet pump is smooth and convergent, while the diffuser is divergent. Additionally, the ratio of the inner diameter, d, of the jet to the inner diameter, D, of the mixing tube ranges from 0.14 to 0.9. Further, the jet standoff distance or driving nozzle distance, l, ranges from 0.8 to 2.0 inches. The mixing tube length, $L_m$, is approximately 7 times the inner diameter of the mixing tube, D.

Embodiments of the present disclosure provide a downhole debris removal tool for removing debris from a completed wellbore with a low rig pump rate. An operator may circulate fluid conventionally down a drillstring at a low flow rate when desirable, e.g., in wellbores with open perforations or where a pressure sensitive formation isolation valve (FIV) is used. The downhole debris removal tool, in accordance with embodiments disclosed herein, lifts (through a vacuum effect) a column of fluid from the bottom of the tool at a velocity high enough to capture heavy debris, such as perforating debris or milling debris, with a low rig pump rate. In contrast, in conventional debris removal tools, high pump flow rates are required to remove such heavy debris. In certain embodiments, the downhole debris removal tool has sufficient capacity to store the collected debris in-situ, thereby providing easy removal and disposal of the debris when the tool is returned to the surface.

Figure 2A:
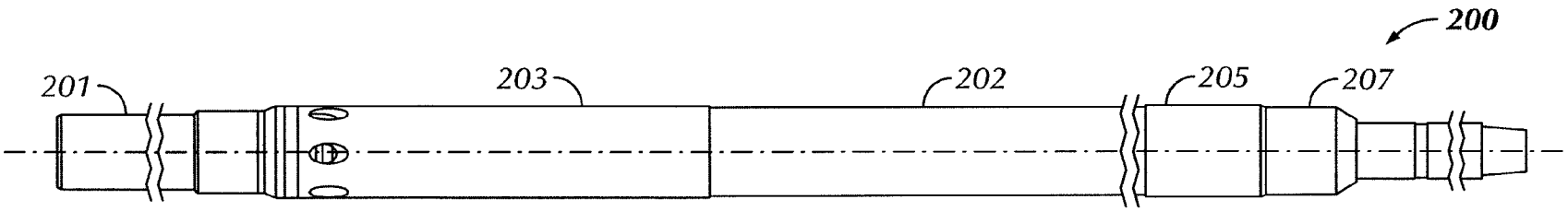
FIGS. 2A and 2B show a side view and a cross sectional view, respectively, of a downhole debris removal tool in accordance with embodiments disclosed herein.
Figure 2B:
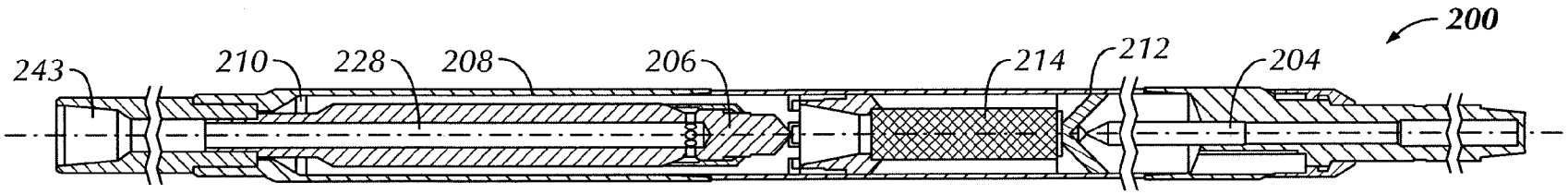

Referring now to FIGS. 2A and 2B, a side view and a cross sectional view of a downhole debris removal tool 200, in accordance with embodiments of the present disclosure, are shown, respectively. The downhole debris removal tool 200 includes a top sub 201, a ported sub 203, a debris sub 202, a bottom sub 205, and a debris removal cap 207. The top sub 201 is configured to connect to a drill string and includes a central bore 243 configured to provide a flow of fluid through the downhole debris removal tool 200. In certain embodiments, the debris sub 202 may be made up of more than one tubing section coupled together. For example, an extension piece, or additional tubing, may be added to the debris sub 202 to provide additional collection and storage space for debris. A section of washpipe (not shown) may be provided below the downhole debris removal tool 200.

The ported sub 203 is disposed below the top sub 201 and houses a mixing tube 208, a diffuser 210, and an annular jet pump sub 206. The ported sub 203 is a generally cylindrical component and includes a plurality of ports configured to align with the diffuser 210 proximate the upper end of the ported sub 203, thereby allowing fluids to exit the downhole debris removal tool 200. The ported sub 203 may be connected to the top sub 201 by any mechanism known in the art, for example, threaded connection, welding, etc.

Figure 4:
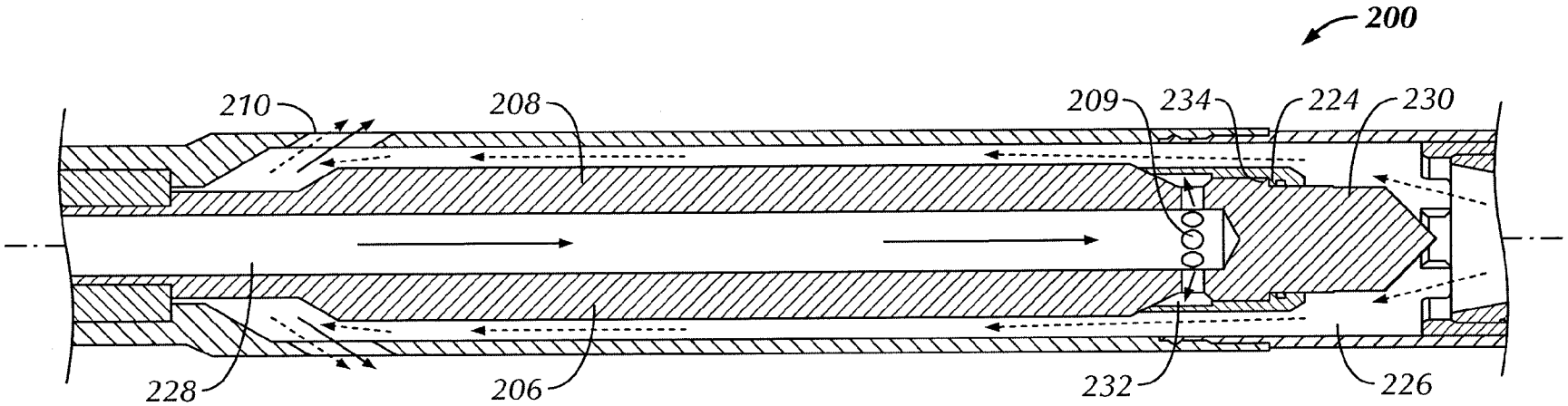
FIG. 4 shows a cross sectional view of a ported sub of downhole debris removal tool in accordance with embodiments disclosed herein.

As shown in more detail in FIG. 4, the annular jet pump sub 206 is a component disposed within the ported sub 203. The annular jet pump sub 206 includes a bore 228 in fluid connection with the central bore of the top sub 201. At least one small opening or jet 209 fluidly connects the bore 228 of the annular jet pump sub 206 to the mixing tube 208. The jets 209 provide a flow of fluid from the drill string into the mixing tube 208 to displace initially static fluid in the mixing tube 208. The fluid then flows upward in the mixing tube 208 and exits the ported sub 203 through the diffuser 210, as indicated by the solid black lines.

Figure 5:
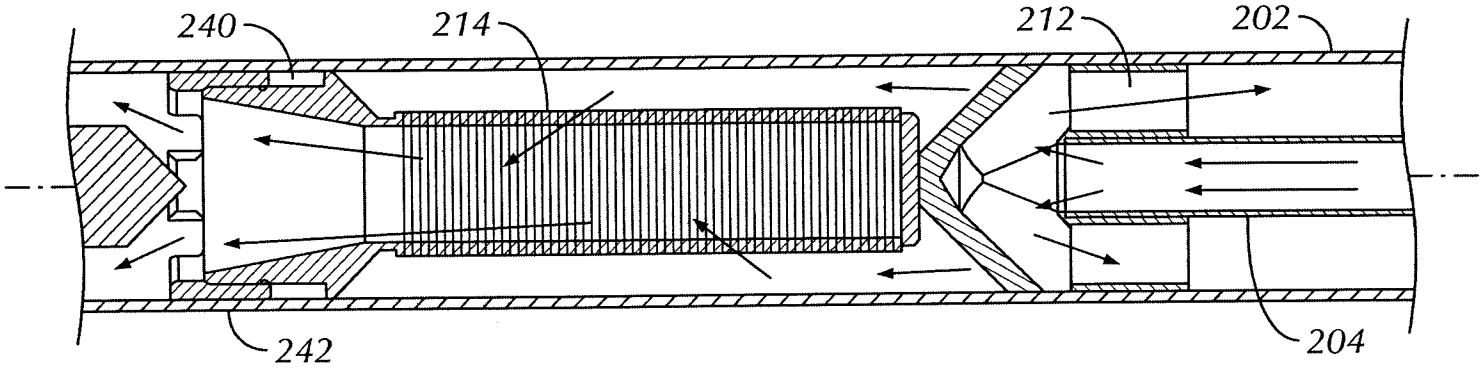
FIG. 5 shows a cross sectional view of a debris sub section of downhole debris removal tool in accordance with embodiments disclosed herein.

Referring to FIGS. 2, 4, and 5, a lower end 230 of the annular jet pump sub 206 is disposed proximate an exit end of a screen 214 disposed in the debris sub 202, forming an inlet 226 into the mixing tube 208. Fluid suctioned up through the debris sub 202 enters the mixing tube 208 through the inlet 226 and exits the mixing tube 208 through one or more diffusers 210. An annular jet cup 232 is disposed over the lower end 230 of the annular jet pump sub 206 and configured to at least partially cover jets 209 to provide a ring nozzle. The at least one jet 209 size may be changed by varying the gap between the annular jet cup 232 and the annular jet pump sub 206, thereby providing for flexible operation of the downhole debris removal tool 200. The gap may be varied by moving the annular jet cup 232 in an uphole or downhole direction along the annular jet pump sub 206. In one embodiment, the annular jet cup 232 may be threadedly coupled to the annular jet pump sub 206, thereby allowing the annular jet cup 232 to be threaded into a position that provides a desired gap between annular jet cup 232 and the annular jet pump sub 206.

A spacer ring 224 may be disposed around the lower end 230 of the annular jet pump sub 206 and proximate a shoulder 234 formed on an outer surface of the lower end 230. The spacer ring 224 is assembled to the annular jet pump sub 206 and the annular jet cup 232 is disposed over the lower end 230 and the spacer ring 224. Thus, the spacer ring 224 limits the movement of the annular jet cup 232. One or more spacer rings 224 with varying thickness may be used to selectively choose the location of the assembled annular jet cup 232, and provide a pre-selected gap between the annular jet cup 232 and the annular jet pump sub 206. That is, the thickness of the spacer ring 224 may be selected so as to provide a desired d/D ratio. Varying the gap between the annular jet cup 232 and the annular jet pump sub 206 also provides for adjustment of the distance of the at least one jet 209 from the mixing tube 208 entrance. Thus, the jet standoff distance (l) of the tool 200 may be increased, thereby promoting jet pump efficiency.

Referring back to FIGS. 2A and 2B, the debris sub 202 is coupled to a lower end of the ported sub 203 and houses a suction tube 204, a flow diverter 212, and the screen 214. The debris sub 202 may be connected to the ported sub 203 by any mechanism known in the art, for example, threaded connection, welding, etc. The debris sub 202 is configured to separate and collect debris from a fluid stream as the fluid is vacuumed or suctioned up through the downhole debris recovery tool 200. Referring also to FIG. 5, the suction tube 204 is configured to receive a stream of fluid and debris from the wellbore and directs the stream through the flow diverter 212. In one embodiment, the flow diverter 212 may be a spiral flow diverter. In this embodiment, the spiral flow diverter is configured to impart rotation to the fluid/debris stream as it enters a debris chamber from the suction tube 204. The rotation imparted to the fluid helps separate the fluid stream from the debris. The debris separated from the fluid stream drops down and is contained within the debris sub 202. A debris removal cap 207 is coupled to a lower end of the debris sub 202 and may be removed from the downhole debris recovery tool 200 at the surface to remove the collected debris from the downhole debris recovery 200 (see FIGS. 6 and 8). The downhole debris recovery tool 200 may be configured to collect a specified anticipated debris volume. The length of the debris sub 202 may be selected based on the anticipated debris volume in the wellbore.

Figure 7:
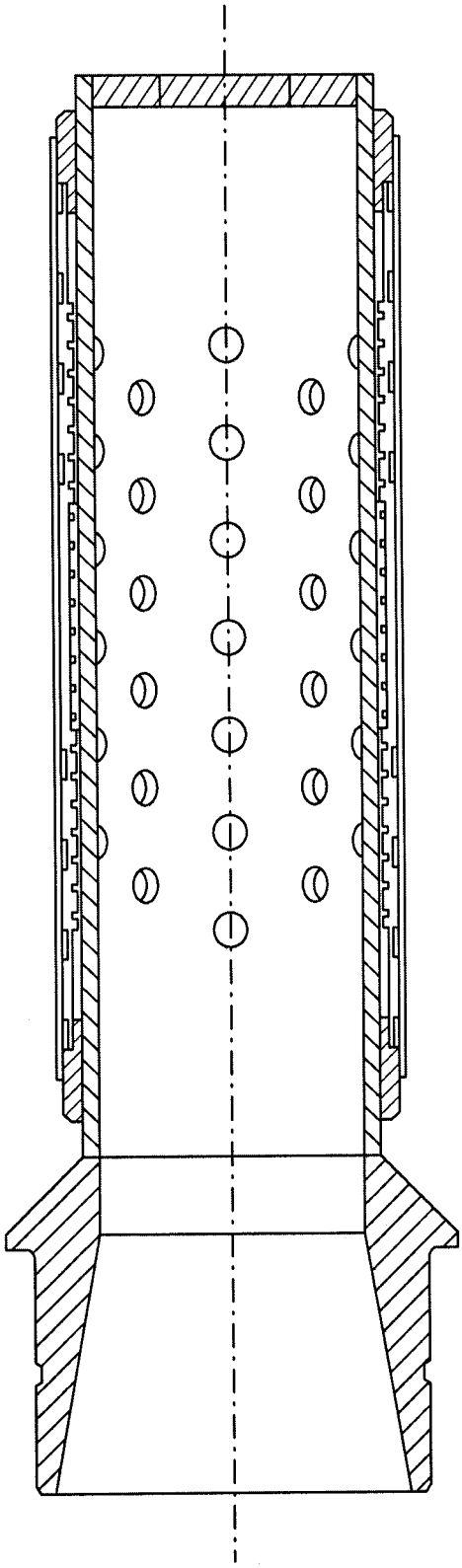
FIG. 7 is a perspective view of a screen of a downhole debris removal tool in accordance with embodiments disclosed herein.

In one embodiment, the screen 214 may be a cylindrical component with a small perforations disposed on an outside surface, as shown in FIG. 7. In alternate embodiments, the outer cylindrical surface of the screening device 214 may be formed from a wire mesh cloth, as shown in FIG. 5. One of ordinary skill in the art will appreciate that any screening device known in the art for debris recovery may be used without departing from the scope of embodiments disclosed herein. In certain embodiments, the screen 214 is a low differential pressure screen. A packing element 240 and an element seal ring 242 are disposed around a pin end of the screen 214 to prevent fluid from bypassing the screen 214. The fluid stream flowing through the diverter 212 enters the screen 214. Debris larger than the perforations or mesh size of the screen cloth remains on the surface of the screen or fall and remain within the debris sub 202. The filtered stream of fluid is then further suctioned up into the ported sub 203.

Figure 3:
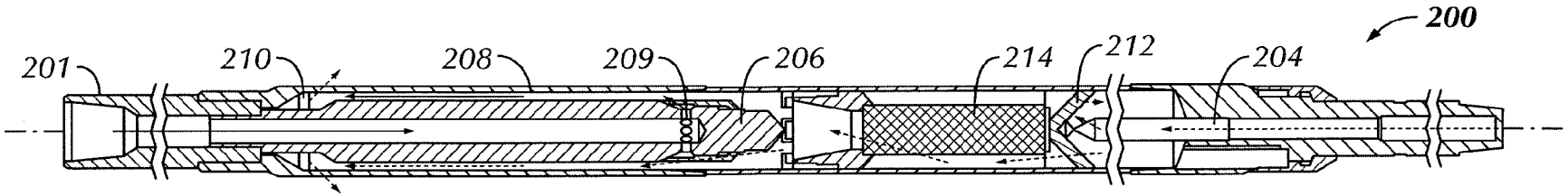
FIG. 3 shows the overall operation of a downhole debris removal tool in accordance with embodiments disclosed herein.

FIG. 3 shows a general overview of the operation of the downhole debris removal tool 200. Solid arrow lines indicate driving flow, while dashed arrow lines indicate suction flow of the tool. As shown, fluid is pumped down through the central bore of the top sub 201 and into the bore 228 of the annular jet pump sub 206. The fluid is pumped at a low flow rate. For example, in certain embodiments, the fluid flowed into the bore 228 of the annular jet pump sub 206 is pumped at a rate of less than 10 BPM. In some embodiments, the fluid flowed through the bore 228 of the annular jet pump sub 206 is pumped at a rate of approximately 7 BPM. The fluid exits the annular jet pump sub 206 through a high pressure jet 209 into the mixing tube 208. Injection of the fluid into the mixing tube 208 displaces the originally static fluid in the mixing tube 208, thereby causing suction at the suction tube 204. The high pressure jet fluid and the entrained fluid mix in the mixing tube 208 and exit through the diffuser 210. The fluid exiting the diffuser 210 and vacuum effect at the suction tube 204 dislodges and removes debris from the wellbore.

Figure 21A:
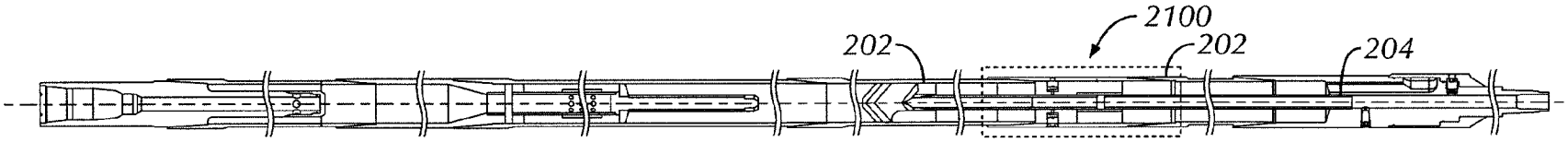
FIG. 21A shows a cross sectional view of a debris catcher tool in accordance with embodiments disclosed herein.
Figure 21B:
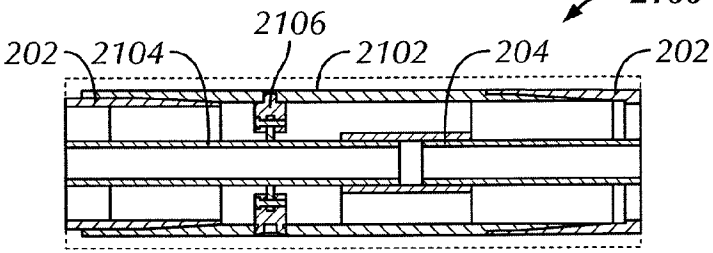
FIG. 21B shows a close-perspective view of portion 2100 of FIG. 21A.

In certain embodiments, at least one extension piece may be added to the downhole debris removal tool to increase the capacity of the debris sub 202 such that more debris may be stored/collected therein. FIGS. 21A and 21B show one embodiment having an extension piece 2100 disposed between two sections of debris sub 202. The at least one extension piece may have an inner tube 2104 configured to align with the suction tube 204. Additionally, in select embodiments, the inner tube 2104 of the expansion piece 2100 may be coupled to a flow diverter 212, and/or inner tubes 2104 of additional expansion pieces 2100. The at least one extension piece 2100 may also have an outer housing 2102 configured to couple to at least one debris sub 202, and/or outer housing 2102 of additional expansion pieces. One of ordinary skill in the art will appreciate that multiple extension pieces may be added to the downhole debris recovery tool, and that components may be coupled by any means known in the art. For example, components may be coupled using threads, welding, etc.

At least one isolation valve 2106 may be integrated into the at least one extension piece 2100, as shown in FIG. 21. Alternatively, one of ordinary skill in the art will appreciate that the extension piece 2100 and the isolation valve 2106 may be independent components, or in another embodiment, the isolation valve 2106 may be integrated into a debris sub 202. In select embodiments, more than one isolation valve may be used such that multiple chambers may be created within the debris removal tool.

Figure 14:
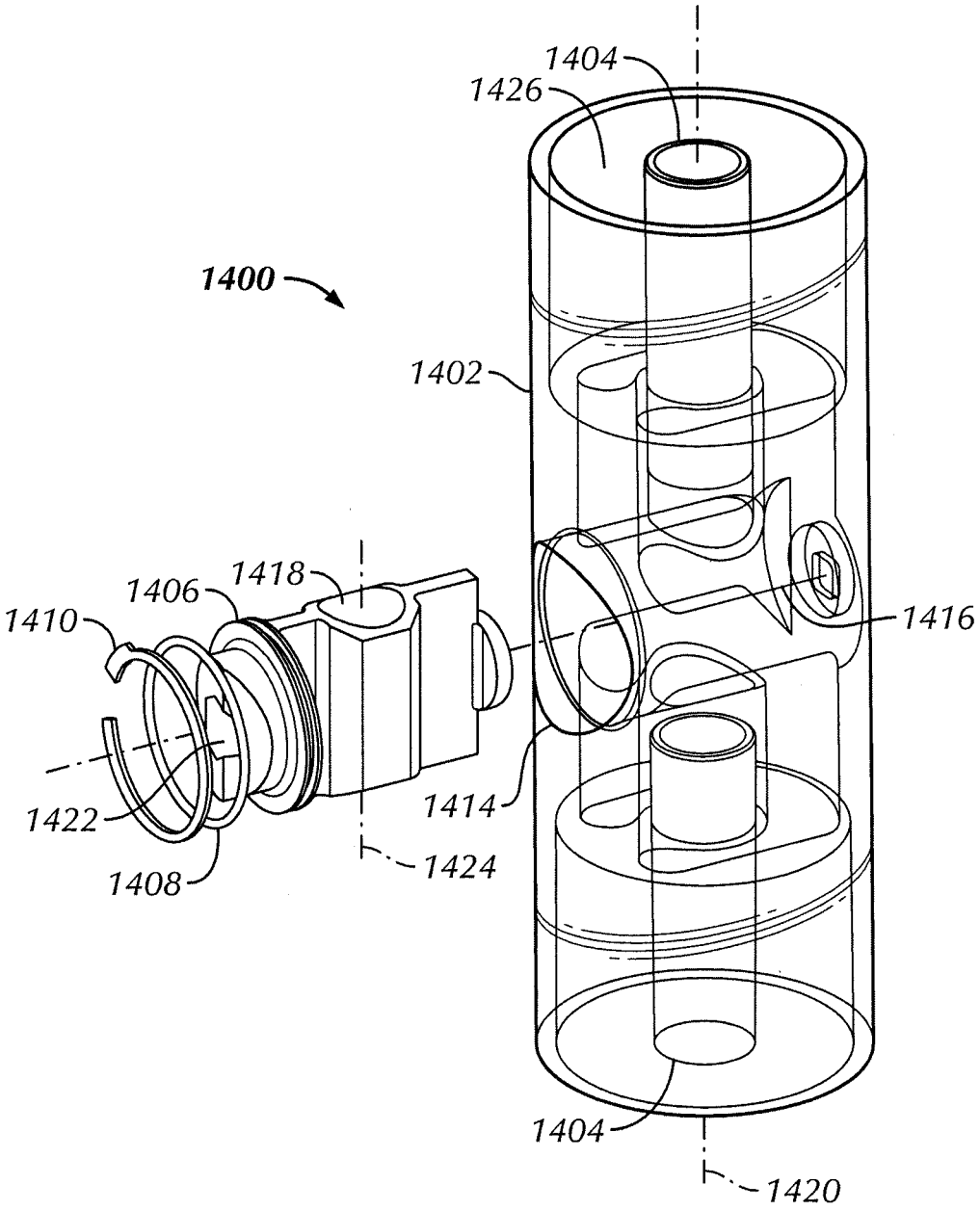
FIG. 14 shows an exploded view of an isolation valve in accordance with embodiments disclosed herein.

Referring to FIG. 14, an isolation valve 1400 in accordance with embodiments disclosed herein is shown. The isolation valve 1400 includes a housing 1402, upper and lower portions of an inner tube, referred to herein as velocity tube 1404, an annular space 1426 disposed between the housing 1402 and the velocity tube 1404, a gate 1406, a cutout 1414, and a central axis 1420. The velocity tube 1404 and the housing 1402 may have inner and outer diameters substantially the same as the inner and outer diameters of suction tube 204 and debris sub 202, respectively, of FIGS. 2A and 2B. The isolation valve 1400 may also include a cutout 1414 disposed through the velocity tube 1404 and the housing 1402, which accommodates a gate 1406. Gate 1406 may rotate a cutout axis 1416. The cutout axis 1416 may be substantially perpendicular to the central axis 1420 of the isolation valve 1400. The gate 1406 may further include an o-ring 1408, a circlip 1410, a hex socket head 1422, a gate hole 1418, and a gate hole axis 1424. The gate hole 1418 may have a diameter substantially equal to the inner diameter of the upper and lower portions of velocity tube 1404.

Figure 15A:
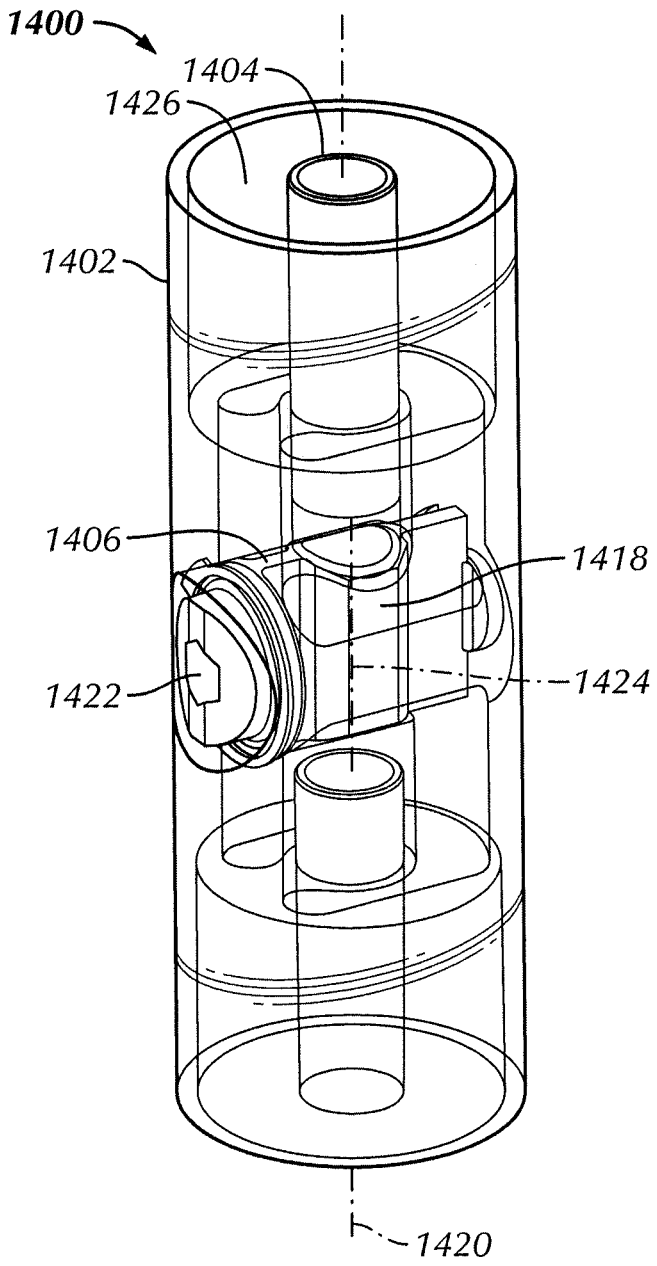
FIGS. 15A and 15B show open and closed configurations, respectively, of an isolation valve in accordance with embodiments disclosed herein.
Figure 15B:
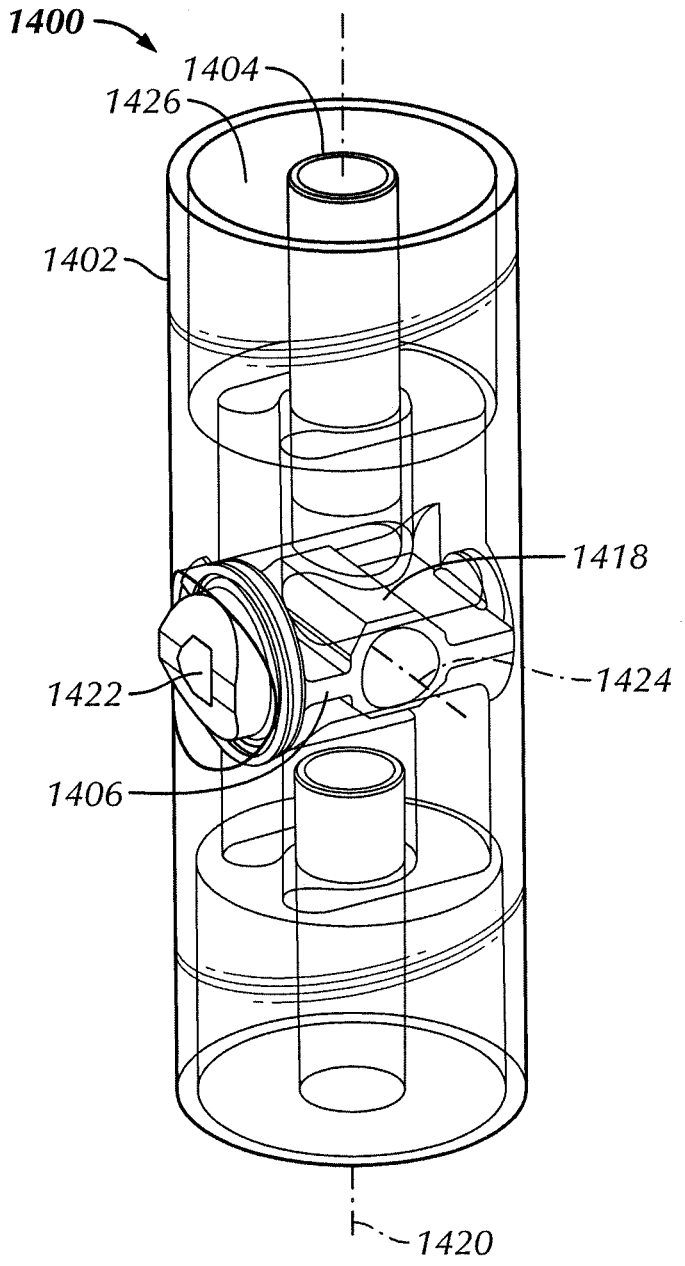

FIGS. 15A and 15B show open and closed configurations, respectively, of the isolation valve 1400 shown in FIG. 14. As shown in FIG. 15A, the isolation valve 1400 is open when the gate hole axis 1424 is axially aligned with central axis 1420, thus allowing flow through both the velocity tube 1404 and the annular space 1426. FIG. 15B shows a closed isolation valve 1400 having the gate hole axis 1424 disposed perpendicular to the central axis 1420. In the closed configuration, flow through the velocity tube 1404 and the annular space 1426 is restricted. In the embodiment shown in FIGS. 14, 15A, and 15B, the hex socket head 1422 may be engaged with a corresponding tool (not shown) and rotated to change the position of the gate 1406 relative to the velocity tube 1404 and annular space 1426. Other socket head geometries, such as square or star socket heads, may also be used. Furthermore, one of ordinary skill in the art will appreciate that other mechanical or hydraulic means for controlling the gate may be used without departing from the scope of the present disclosure. For example, a shearing pin may be used to control the actuation of isolation valve 1400 in accordance with embodiments disclosed herein.

Figure 16:
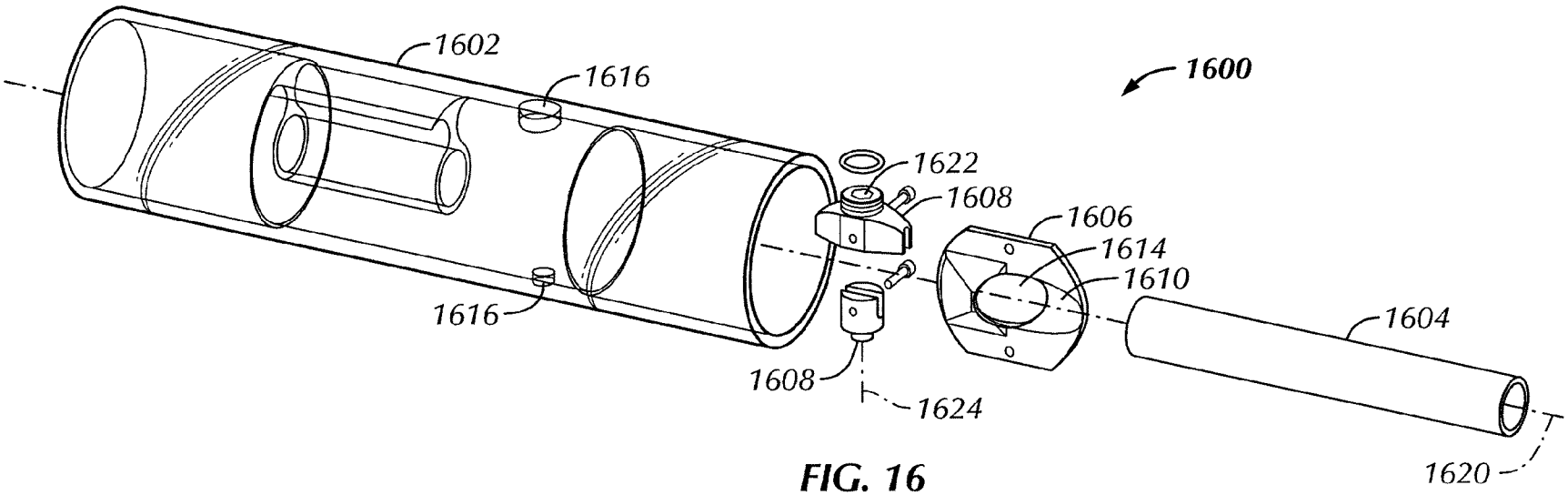
FIG. 16 shows an exploded view of an isolation valve in accordance with embodiments disclosed herein.
Figure 17A:
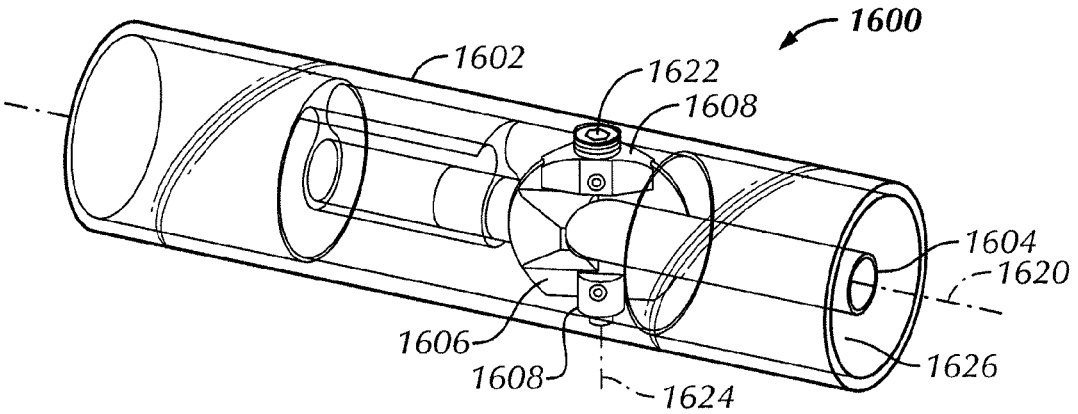
FIGS. 17A and 17B show open and closed views, respectively, of an isolation valve in accordance with embodiments disclosed herein.
Figure 17B:
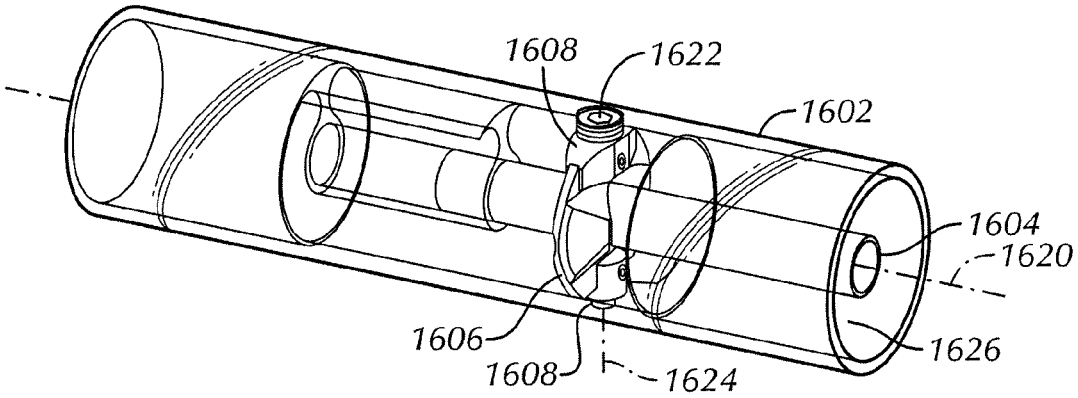

FIGS. 16, 17A, and 17B show another exemplary isolation valve 1600 in accordance with the embodiments disclosed herein. Isolation valve 1600 allows uninterrupted flow through velocity tube 1604 and selectively allows flow through annular space 1626. Isolation valve 1600 includes a housing 1602, a velocity tube 1604, an annular space 1626 disposed between housing 1602 and velocity tube 1604, a central axis 1620, a gate 1606, and rotatable brackets 1608. The gate 1606 may further include a hole 1614 through which velocity tube 1604 is disposed, and at least one curved surface 1610 configured to allow movement of the gate 1606 relative to the velocity tube 1604. Rotatable brackets 1608 may be configured to couple to the gate 1606 and to bracket holes 1616 disposed in the housing 1602. Additionally, a hex socket head 1622 may be disposed on at least one of the rotatable brackets 1608. Alternatively, other socket head geometries, such as square or star socket heads, may be used. The rotatable brackets 1608, together with the gate 1606, may be rotated about a gate axis 1624 relative to the velocity tube 1604.

Figure 18A:
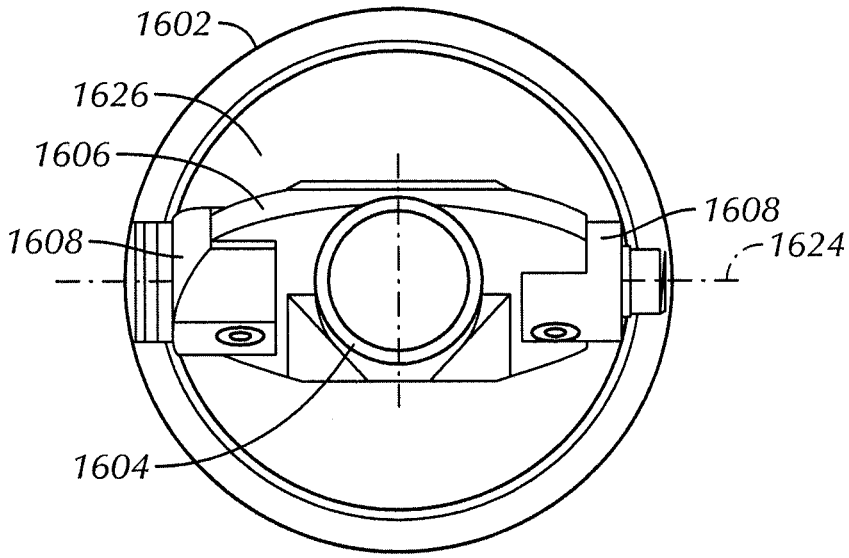
FIGS. 18A and 18B show open and closed cross sectional views, respectively, of an isolation valve in accordance with embodiments disclosed herein.
Figure 18B:
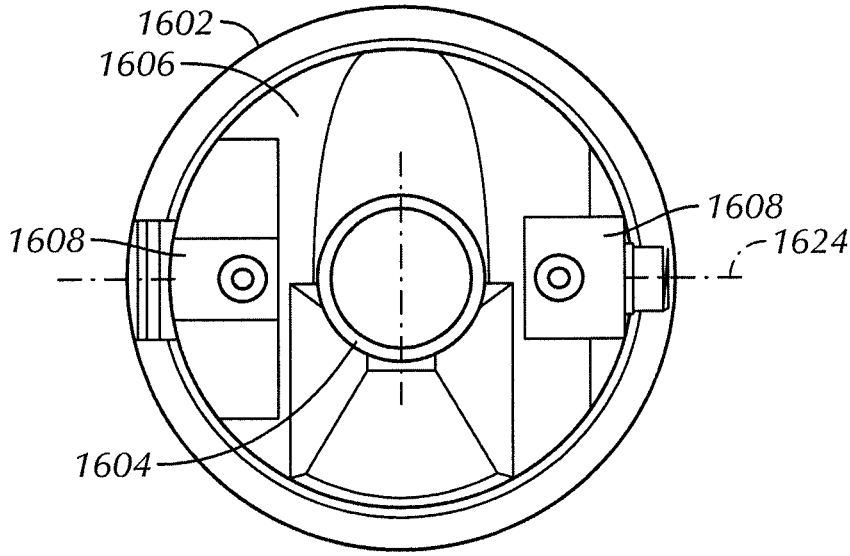

Referring to FIGS. 17A and 18A, an isolation valve 1600 is shown in an open position in accordance with embodiments disclosed herein. The gate 1606 may be positioned such that flow through the annular space 1626 is allowed (FIG. 17A). In certain embodiments, the at least one curved surface 1610 of the opened gate 1606 may contact an outer surface of the velocity tube 1604. Referring to FIGS. 17B and 18B, the gate 1606 of isolation valve 1600 may be positioned such that flow through the annular space 1626 is restricted. In the embodiment shown in FIGS. 17A, 17B, 18A, and 18B, flow through the velocity tube 1604 of isolation valve 1600 is allowed, regardless of the position of gate 1606.

During operation, the at least one isolation valve remains open so that the suction action of the tool is maintained. It may be advantageous to close the at least one isolation valve when the downhole debris removal tool is pulled from the well so that an extension piece may be installed. While the isolation valve is in the closed position, components may be added, removed, and/or replaced therebelow without fluid and debris that may have accumulated above the isolation valve spilling out into the wellbore or onto the deck. Additionally, after the debris removal tool is removed from the well, components therebelow may be removed and the isolation valve may be opened so that accumulated debris may be removed from the tool.

Referring back to FIG. 3, suction at the suction tube 204 provided by the annular jet pump sub 206 may draw fluid and debris into the downhole debris removal tool 200, and through at least one isolation valve. After passing through the at least one isolation valve, the flow diverter 212 diverts the fluid/debris mix from the suction tube 204 downward, as shown in more detail in FIG. 5. The flow diverter 212 is configured to provide rotation to the fluid stream as it is diverted downwards. The rotation provided to the fluid stream may help separate the debris from the fluid stream due to the centrifugal effect and the greater density of the debris. Thus, the flow diverter 212 separates larger pieces of debris from the fluid. The debris separated from the fluid streams drop downwards within the debris sub 202. After the fluid stream exits the diverter, it travels through the screen 214. The screen 214 is configured to remove additional debris entrained in the fluid stream.

Figure 22:
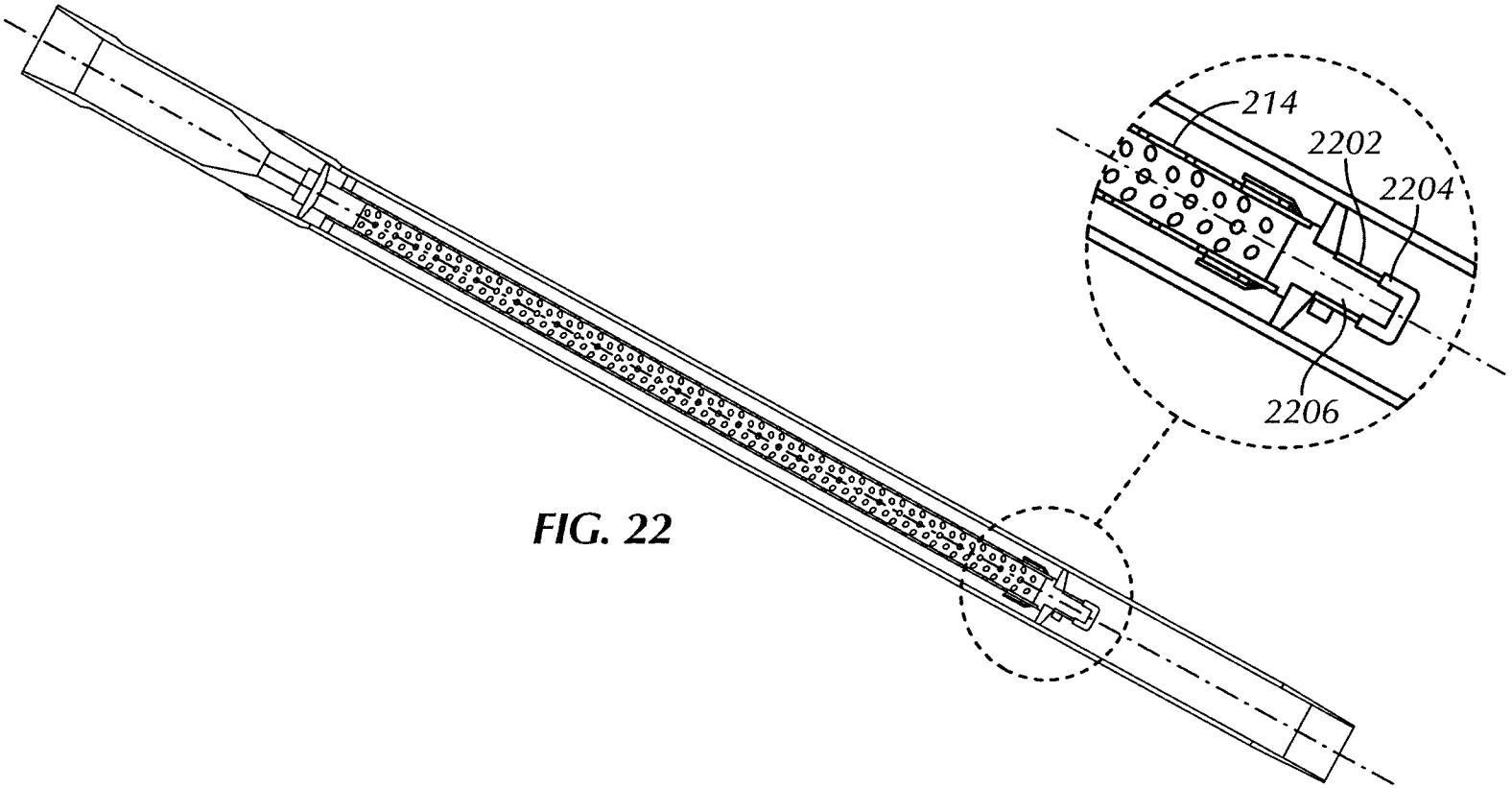
FIG. 22 shows a detailed view of a portion of a debris catcher tool in accordance with embodiments disclosed herein.

As shown in FIG. 22, in select embodiments, at least one magnet 2202 may be disposed on or near a lower end of the screen 214. The magnets 2202 may magnetically attract metallic debris suspended in the fluid and may prevent the metallic debris from clogging the screen 214. FIG. 22 shows an embodiment having magnets 2202 that are ring-shaped and disposed around an outer surface of shaft 2206. The magnets may be rare earth magnets, such as samarium-cobalt or neodymium-iron-boron (NIB) magnets. One of ordinary skill in the art will appreciate that magnets of other shapes and sizes may also be used. Additionally, the embodiment of FIG. 22 shows a magnet cover 2204 disposed around the magnets 2202 such that the fluid may not directly contact the magnets 2202. The cover 2204 may protect the magnets 2202 from being damaged by debris.

Referring back to FIG. 3, after passing through the screen 214, the fluid flows past the annular jet pump sub 206 into the mixing tube 208. The fluid is then returned to the casing annulus (not shown) through the diffuser 210. In embodiments disclosed herein, as shown in FIGS. 2-8, the fluid entering the mixing tube 208 from the suction tube 204 does not significantly change direction until after the fluid enters the diffuser 210 and is diverted into the casing annulus. In contrast, in conventional debris removal tools with conventional nozzle arrangements, fluid flowing from the suction tube changes direction 180 degrees to enter the mixing tube.

Figure 6:
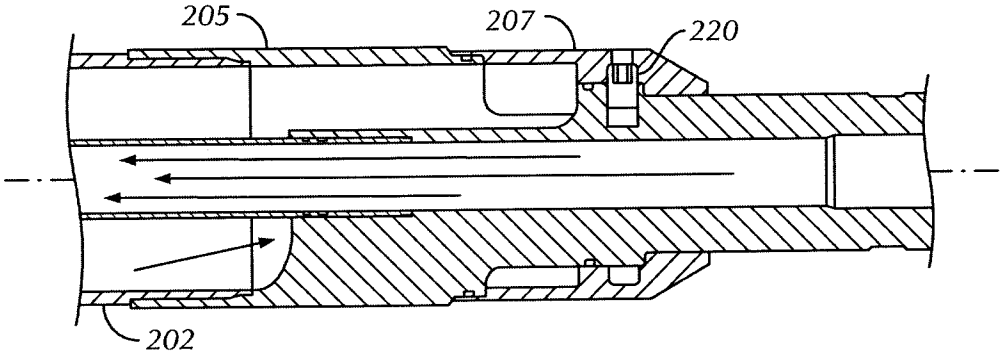
FIG. 6 shows a cross sectional view of a bottom sub and a debris removal cap of a downhole debris removal tool in accordance with embodiments disclosed herein.
Figure 8:
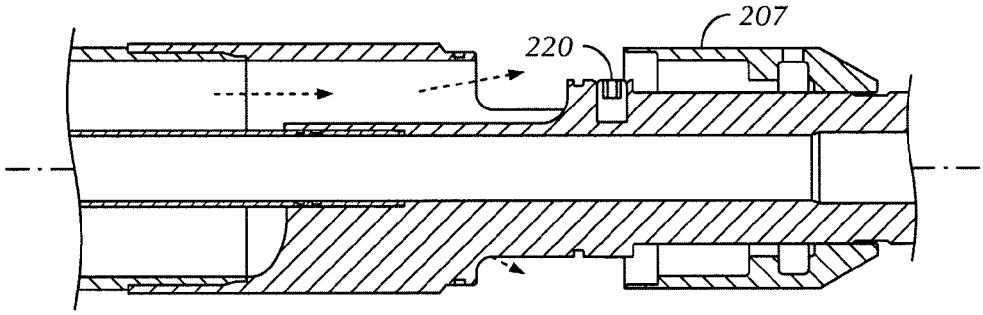
FIG. 8 shows a cross sectional view of a bottom sub and a debris removal cap of downhole debris removal tool in accordance with embodiments disclosed herein, with the debris removal cap removed from its assembled position.

After completion of the debris recovery job, the drill string is pulled from the wellbore and the downhole debris recovery tool 200 is returned to the surface. As shown in FIGS. 6 and 8, a retaining screw 220 may be removed from the debris removal cap 207 to allow the debris removal cap 207 to be removed from the downhole debris recovery tool 200, thereby allowing the debris to be easily removed (indicated by dashed arrows) from the debris sub 202.

Figure 19:
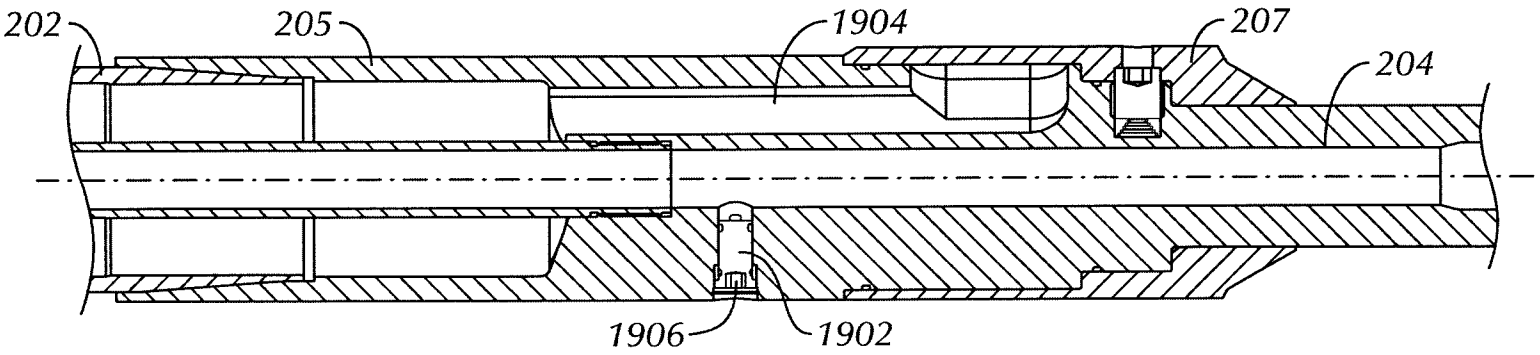
FIG. 19 shows a cross sectional view of a portion of a debris catcher tool in accordance with embodiments disclosed herein.
Figure 20B:
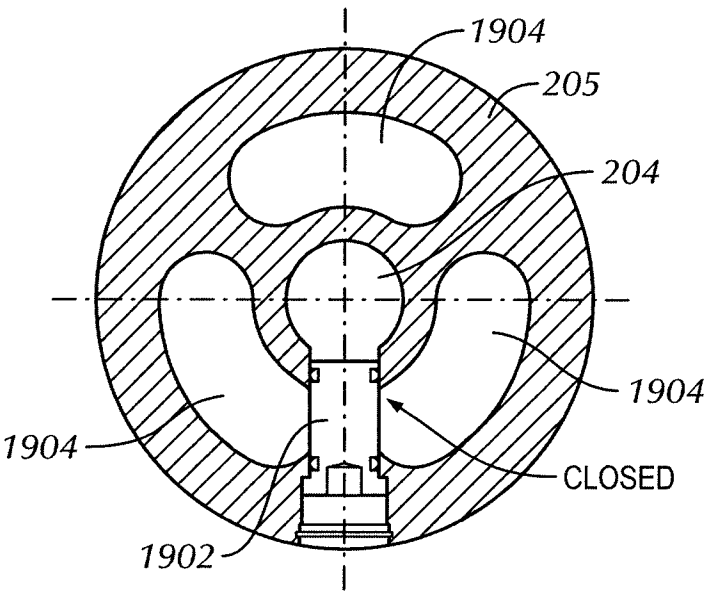
FIGS. 20A and 20B show open and closed cross sectional views, respectively, of a drain pin in accordance with embodiments disclosed herein.
Figure 20A:
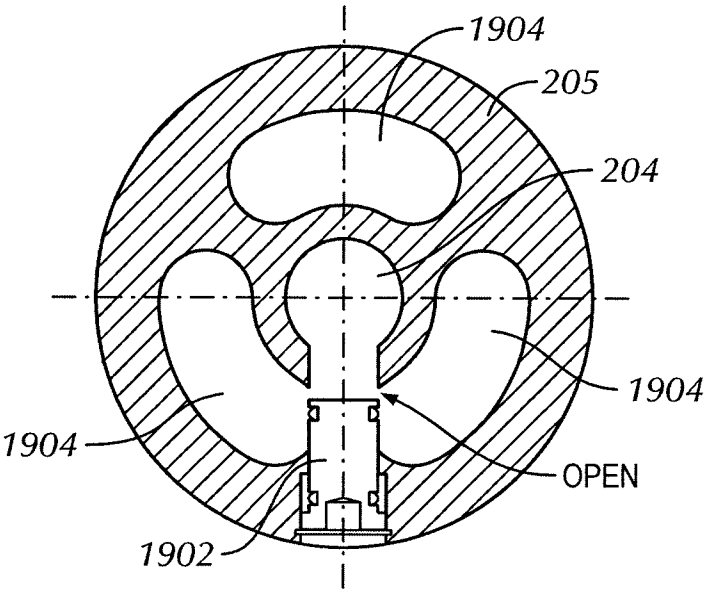

In certain embodiments, a drain pin may be disposed in bottom sub 205 and may be opened before removing debris removal cap 207 so that fluid may be emptied from the bottom sub 205 and/or the debris sub 202. Referring to FIG. 19, the drain pin 1902 may be opened to allow fluid from at least one cavity 1904, disposed in bottom sub 205, to flow out through suction tube 204. In certain embodiments, a hex socket head 1906 may be disposed on the drain pin 1902. One of ordinary skill in the art will appreciate that alternative socket geometries, such as square or star, may be used without departing from the scope of the present disclosure. The hex socket head 1906 may be engaged with a corresponding tool (not shown) and rotated to open or close the drain pin 1902. FIGS. 20A and 20B show cross-sectional views of a debris removal tool having a drain pin 1902. FIG. 20A shows drain pin 1902 in the open position, allowing fluid communication between at least one cavity 1904 and suction tube 204. In certain embodiments, the space created by the opened drain pin 1902 may be sized to prevent debris from escaping with the fluid. FIG. 20B shows drain pin 1902 in the closed position preventing fluid in cavity 1904 from entering suction tube 204. It may be advantageous to open drain pin 1902 prior to removing debris removal cap 207 so that fluid may be released from the tool before debris removal, thereby preventing the fluid from spilling out onto, for example, the rig floor.

Figure 13A:
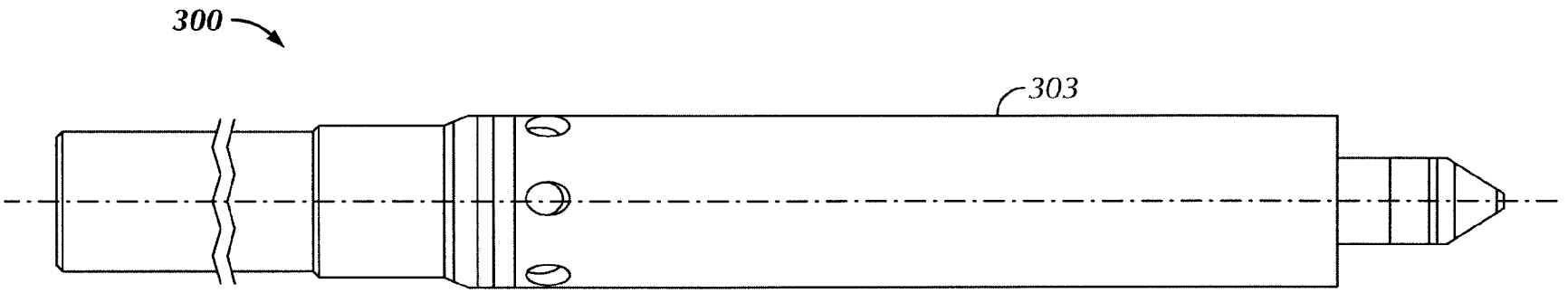
FIGS. 13A and 13B show perspective and cross sectional views, respectively, of an annular jet pump sub in accordance with embodiments disclosed herein.
Figure 13B:
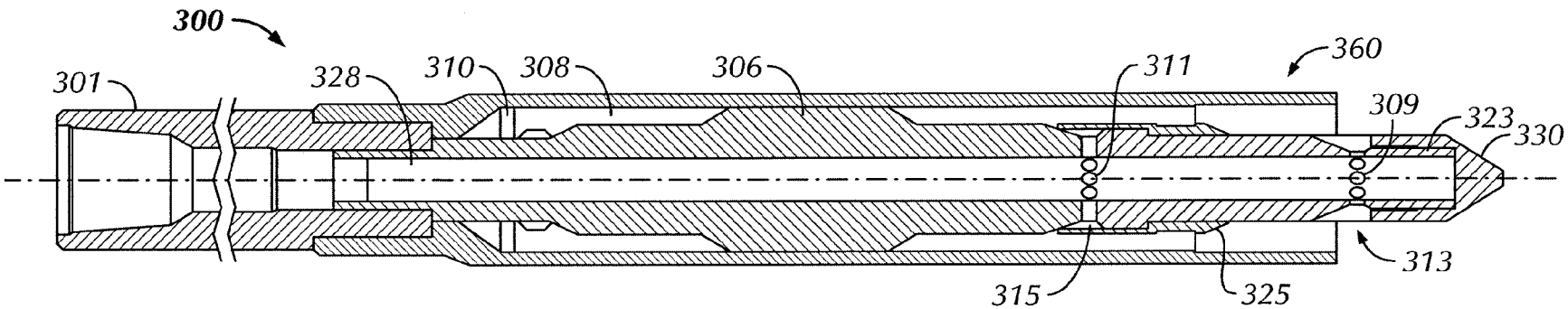

Referring now to FIGS. 13A and 13B, an alternate embodiment of an annular jet pump sub 306 in accordance with embodiments of the present disclosure is shown. Annular jet pump sub 306 is disposed within a ported sub 303 which provides a mixing tube 308, and includes a two staged annular jet pump 360. As shown, the annular jet pump sub 306 includes two stages 313, 315. The annular jet pump sub 306 includes a bore 328 in fluid connection with the central bore of a top sub 301. As shown, the first stage 313 includes at least one small opening or jet 309 disposed near a lower end of the annular jet pump sub 306 and the second stage 315 includes at least one small opening or jet 311 disposed axially above the first stage 313. The jets 309, 311 fluidly connect the bore 328 of the annular jet pump sub 306 to the mixing tube 308.

The two stages 313, 315 of the annular jet pump sub 306 may provide a more efficient pumping tool. In particular, the two staged annular jet pump 360 may reduce the pumping flow rate of the tool and double the overall efficiency of the downhole debris removal tool 300. In the embodiment shown in FIGS. 13A and 13B, a flow of fluid exits the annular jet pump sub 306 through jets 309 of first stage 313 into mixing tube 308. Injection of the fluid into the mixing tube 308 displaces the originally static fluid in the mixing tube 308, thereby causing suction at a suction tube (204 in FIG. 3) disposed below the annular jet pump sub 306. Additionally, a flow of fluid exits the annular jet pump sub 306 through jets 311 of second stage 315 into mixing tube 308. The flow of fluid exiting the annular jet pump sub 306 through second stage 315 accelerates fluid flow in the mixing tube 308. The fluid then flows upward in the mixing tube 308 and exits the ported sub through the diffuser 310. The suction provided by the first stage 313 and the acceleration of fluid provided by the second stage 315 of the annular jet pump sub 306 may allow a small volume of fluid to pull a larger volume of fluid with a lower pressure than a one-stage annular jet pump.

Referring to FIGS. 5 and 13 together, a lower end 330 of the annular jet pump sub 306 is disposed proximate an exit end of a screen 214 disposed in the debris sub 202, forming an inlet (not shown) into the mixing tube 308. Fluid suctioned up through the debris sub 202 enters the mixing tube 308 through the inlet (inlet) and exits the mixing tube 308 through one or more diffusers 310. An annular jet cup 323 may be disposed over the lower end 330 of the annular jet pump sub 306 and configured to at least partially cover jets 309 of the first stage 313 to provide a ring nozzle. A second annular jet cup 325 may be disposed around the annular jet pump sub 306 proximate the second stage 315 and configured to at least partially cover jets 311 to provide a ring nozzle. One of ordinary skill in the art will appreciate that based on the specific needs of a given application, the annular jet pump sub 306 may include an annular jet cup 323 for only the first stage 313, an annular jet cup 325 for only the second stage 315, or an annular jet cup 323, 325 for both the first and second stages 313, 315. The size of the jets 309, 311 may be changed by varying the gap between the annular jet cup 323, 325 and the annular jet pump sub 306, thereby providing for flexible operation of the downhole debris removal tool 300. The gap may be varied by moving the annular jet cup 323, 325 in an uphole or downhole direction along the annular jet pump sub 306. In one embodiment, the annular jet cup 323, 325 may be threadedly coupled to the annular jet pump sub 306, thereby allowing the annular jet cup 323, 325 to be threaded into a position that provides a desired gap between the annular jet cup 323, 325 and the annular jet pump sub 306.

As discussed above, a spacer ring (not shown) may be disposed around the lower end 330 of the annular jet pump sub 306 and proximate a shoulder (not shown) formed on an outer surface of the lower end 330. The spacer ring (not shown) may limit the movement of the annular jet cup 323, 325. One or more spacer rings with varying thickness may be used to selectively choose the location of the assembled annular jet cup 323, 325, and provide a pre-selected gap between the annular jet cup 323, 325 and the annular jet pump sub 306. That is, the thickness of the spacer ring may be selected so as to provide a desired d/D ratio. Varying the gap between the annular jet cup 323, 325 and the annular jet pump sub 306 also provides for adjustment of the distance of the at least one jet 309, 311 from the mixing tube 308 entrance. Thus, the jet standoff distance (l) of the tool 300 may be increased, thereby promoting jet pump efficiency Tests Tests were run on various embodiments of the present disclosure. A summary of these tests and the results determined are described below.

A 7⅞" downhole debris recovery tool, in accordance with embodiments disclosed herein, was tested to evaluate the suction flow (flow at the pin end of the tool) for a given driving flow (pump flow rate through the tool). The flow rates at each location were determined using flow meters. To evaluate the suction flow, fluid was pumped through the tool at 20-425 gpm for 2-3 minutes at each pump rate. Pump pressure, pump flow rate, and in-line flow meter rate were recorded. The tool was tested with various spacer rings to provide 0.16 d/D, 0.25 d/D, and 0.39 d/D ratio rings. The results of this part of the test are summarized below in Tables 1-3.

TABLE 1

0.16 d/D Ratio Ring Test Results

| Pump Rate (GPM) | Standpipe pressure (PSI) | Flow Meter Rate (GPM) |
|---|---|---|
| 30 | 50 | 11.5 |
| 45 | 100 | 17 |
| 65 | 175 | 24.5 |
| 90 | 350 | 40 |
| 120 | 450 | 58.5 |
| 140 | 500 | 73 |
| 250 | 350 | 75 |
| 275 | 450 | 85.5 |
| 300 | 500 | 79.5 |
| 325 | 650 | 88 |
| 350 | 750 | 89 |
| 375 | 800 | 91 |

TABLE 2

0.25 d/D Ratio Ring Test Results

| Pump Rate (GPM) | Standpipe pressure (PSI) | Flow Meter Rate (GPM) |
|---|---|---|
| 300 | 250 | 57.5 |
| 325 | 300 | 65 |
| 350 | 400 | 69 |
| 375 | 450 | 75.6 |
| 400 | 525 | 81 |
| 425 | 600 | 85 |

TABLE 3

0.39 d/D Ratio Ring Test Results

| Pump Rate (GPM) | Standpipe pressure (PSI) | Flow Meter Rate (GPM) |
|---|---|---|
| 300 | 37 | 31.5 |
| 325 | 50 | 40.5 |
| 350 | 75 | 42.5 |
| 375 | 100 | 46.5 |
| 400 | 125 | 52 |
| 425 | 150 | 55.5 |

Figure 9:
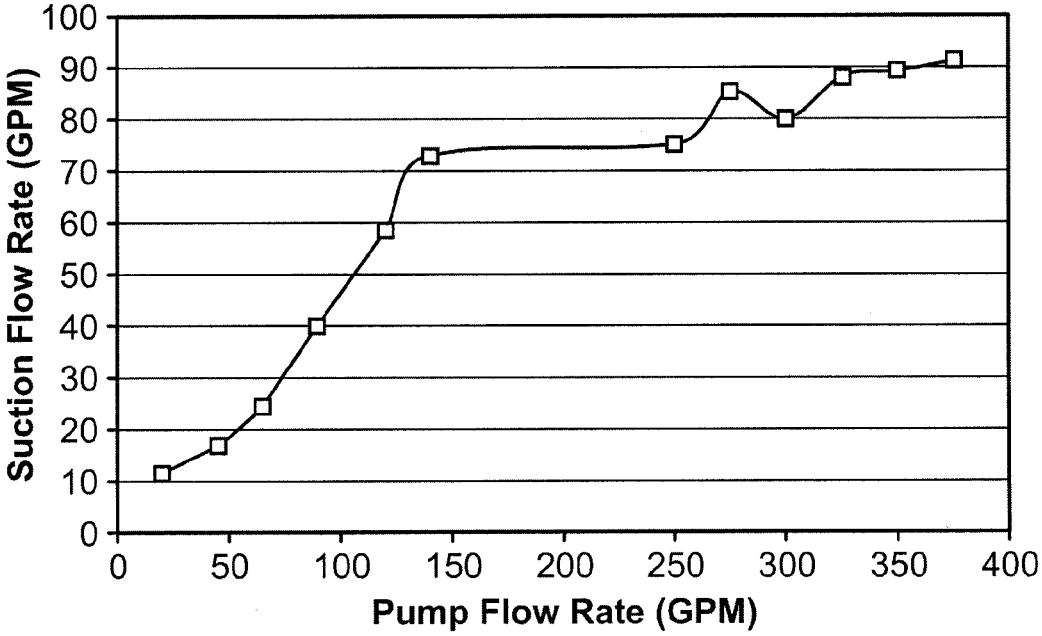
FIGS. 9-11 are graphs of suction flow rate versus the pump flow rate for 0.16 d/D, 0.25 d/D, and 0.39 d/D ratio rings, respectively, of a downhole debris removal tool in accordance with embodiments disclosed herein.
Figure 10:
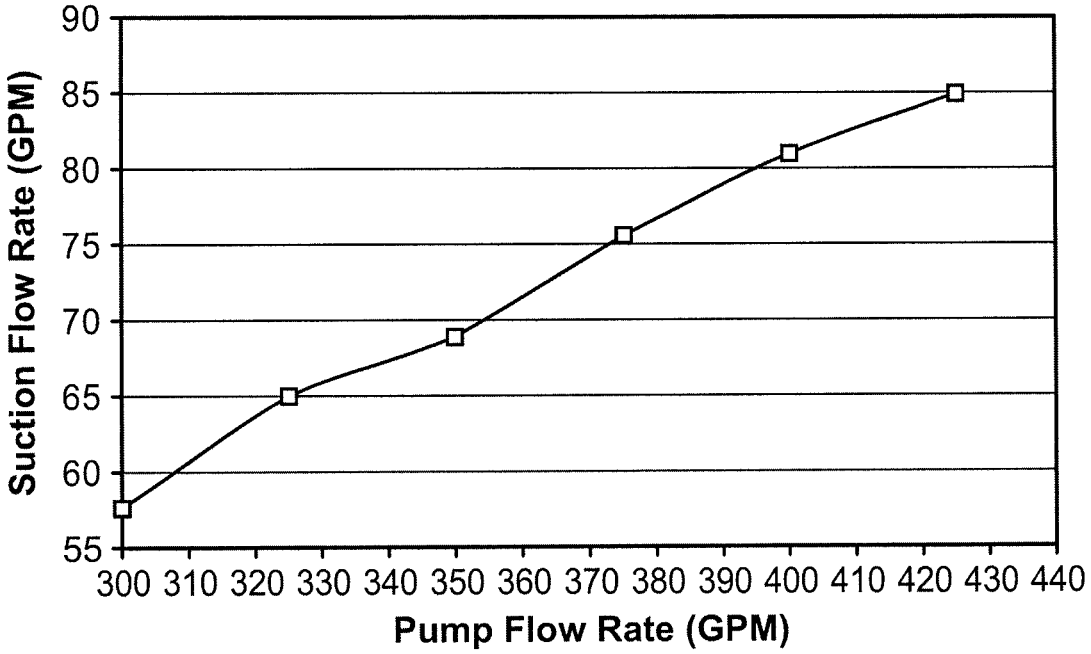
Figure 11:
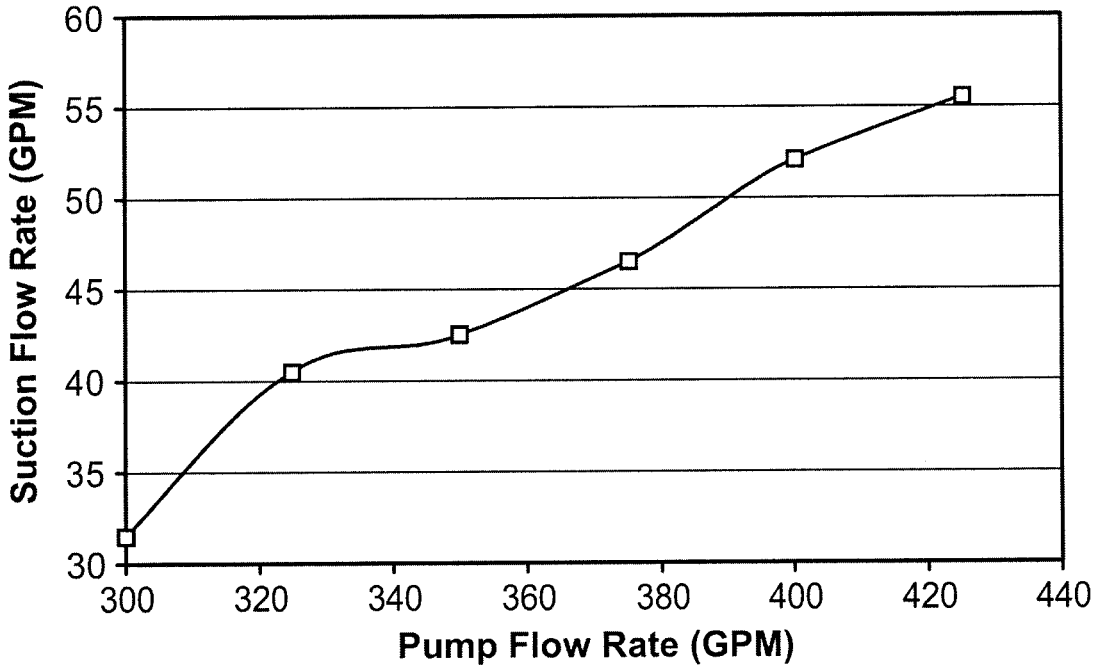

Plots of suction flow rate versus the pump flow rate are shown in FIGS. 9-11 for the 0.16 d/D, 0.25 d/D, and 0.39 d/D ratio rings, respectively.

Figure 12:
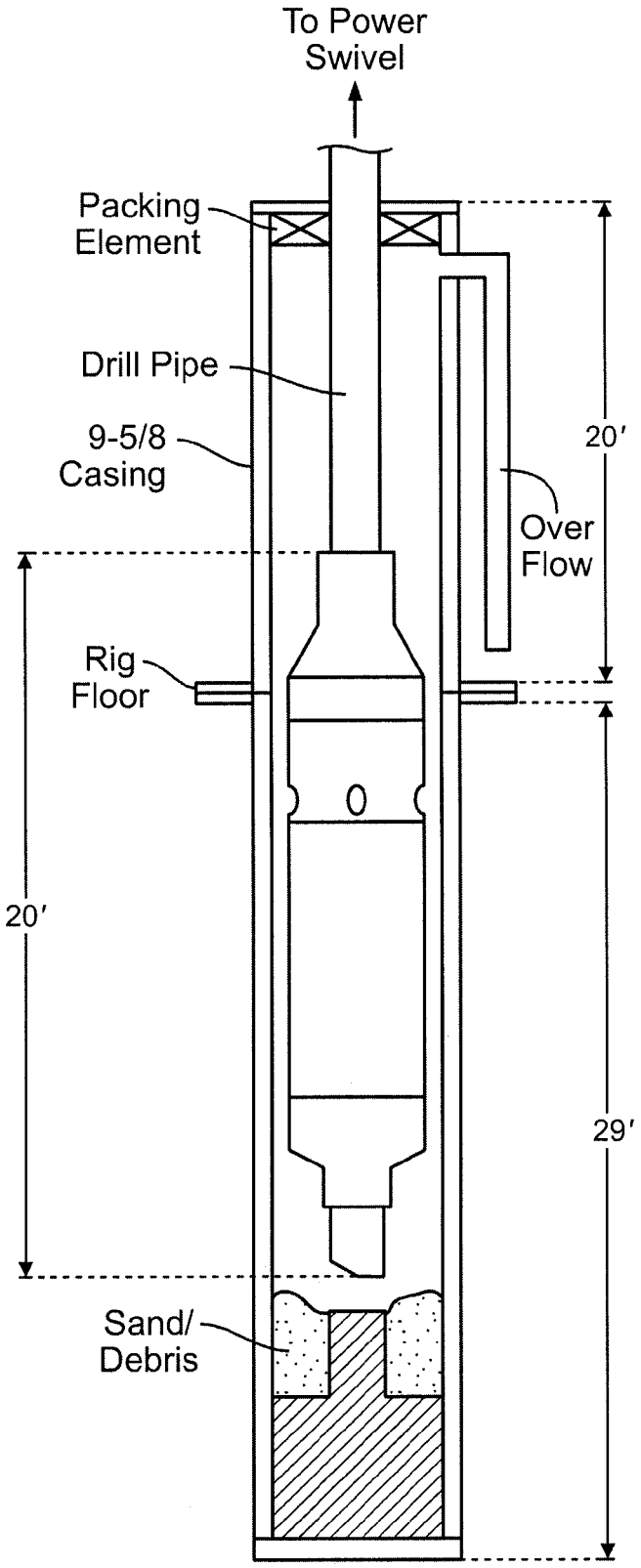
FIG. 12 is a schematic view of a test procedure for evaluating the amount of debris lifted by a downhole debris removal tool in accordance with embodiments disclosed herein.

Additionally, the 7⅞" downhole debris recovery tool was tested to determine if the tool could lift heaving casing debris along with sand. The debris used in each test varied and included sand, metal debris, set screws, gravel, and o-rings. In one test, a packer plug retrieval/perforating debris cleaning trip after firing perforating guns was replicated. FIG. 12 shows the test step up for this part of the test. For this test, a packer plug fixture was placed in the casing and 125 lbs of sand was poured on top of the plug. Then, 10-20 lbs of perforating debris was poured on top of the sand. Fluid was pumped through the tool at 200 GPM. Once the test was completed, the debris removal cap was removed and the debris was collected and measured. The results of this part of the test are summarized in Tables 9 and 10 below for 0.25 d/D ratio ring and 0.16 d/D ratio, respectively, where TD is target depth.

TABLE 4

| Metal Debris Test - 200 GPM | | | | | |
|---|---|---|---|---|---|
| RPM | Circulation Time | Circulation Pressure (PSI) | Pump Rate (GPM) | Debris Dropped | Debris Recovered |
| 15-20 | (7 mins to TD) 5 min circulation after reaching TD | 150-200 | 200-220 | 15 lbs steel shavings; 100¼-20 screws; 100⅜-16 screws | 12 lbs steel shavings; 13¼-20 screws; 24⅜-16 screws |

TABLE 5

| Partial Sand Load and Metal Debris Test - 200 GPM | | | | | |
|---|---|---|---|---|---|
| RPM | Circulation Time | Circulation Pressure (PSI) | Pump Rate (GPM) | Debris Dropped | Debris Recovered |
| 15-20 | (8 mins to TD) 5 min circulation after reaching TD (1st trip) | 150-200 | 220 | 15 lbs steel shavings; 100¼-20 screws; 100⅜-16 screws; 150 lbs sand; 100 lbs rocks | 115 lbs steel shavings, sand, and rocks |
| 15-20 | (8 mins to TD) 5 min circulation after reaching TD (2nd trip) | 400 | 305 | Same | 105 lbs steel shavings, sand, and rocks |

TABLE 6

| Full Sand Load Test - 200 GPM | | | | | |
|---|---|---|---|---|---|
| RPM | Circulation Time | Circulation Pressure (PSI) | Pump Rate (GPM) | Debris Dropped | Debris Recovered |
| 15-20 | (8 mins to TD) 5 min circulation after reaching TD (1st trip) | 150-200 | 222 | 300 lbs sand | 170 lbs sand |

TABLE 6-continued

| Full Sand Load Test - 200 GPM | | | | | |
|---|---|---|---|---|---|
| RPM | Circulation Time | Circulation Pressure (PSI) | Pump Rate (GPM) | Debris Dropped | Debris Recovered |
| 15-20 | (5 mins to TD) 5 min circulation after reaching TD (2nd trip) | 400-500 | 410 | Same | 190 lbs sand |

TABLE 7

| Partial Sand Load and O-ring Test - 200 GPM | | | | | |
|---|---|---|---|---|---|
| RPM | Circulation Time | Circulation Pressure (PSI) | Pump Rate (GPM) | Debris Dropped | Debris Recovered |
| 15-20 | (5 mins to TD) 5 min circulation after reaching TD (1st trip) | 150-200 | 220 | 150 lbs sand; 8 3" o-rings; 5 plastic ring chucks; 7 o-ring chunks; 10 0.75" o-rings | 108 lbs sand; 10 0.75" o-rings; 1 plastic ring chunks; 1 o-ring chunk |

TABLE 8

| Partial Sand Load and Metal Debris Test - 400 GPM | | | | | |
|---|---|---|---|---|---|
| RPM | Circulation Time | Circulation Pressure (PSI) | Pump Rate (GPM) | Debris Dropped | Debris Recovered |
| 15-20 | (7 mins to TD) 5 min circulation after reaching | 400-500 | 416 | 15 lbs steel shavings; | Less than 20 lbs sand, |

TABLE 8-continued

| Partial Sand Load and Metal Debris Test - 400 GPM | | | | | |
|---|---|---|---|---|---|
| RPM | Circulation Time | Circulation Pressure (PSI) | Pump Rate (GPM) | Debris Dropped | Debris Recovered |
| | TD (1st trip) | | | 100¼-20 screws; 100/-16 screws; 150 lbs sand; 100 lbs rocks | gravel, metal shavings |
| 15-20 | (5 mins to TD) 5 min circulation after reaching TD (2nd trip) | 400-500 | 410 | Same | 177 lbs steel shavings, sand, rocks, 1⅜-16 screw |

TABLE 9

| Packer Plug Perforation Debris Test with 0.25 d/D Ratio Ring | | | | | |
|---|---|---|---|---|---|
| RPM | Circulation Time | Circulation Pressure (PSI) | Pump Rate (GPM) | Debris Dropped | Debris Recovered |
| 15-20 | (4 mins to TD) 2 min circulation after reaching TD (1st trip) | 150-200 | 250 | 15 lbs perf. Gun debris 125 lbs sand | 100 lbs Sand and some debris |
| 15-20 | (3 mins to TD) 2 min circulation after reaching TD (2nd trip) | 400 | 400 | Same | 3.5 lbs steel perf. Gun debris, some sand |

TABLE 10

| Packer Plug Perforation Debris Test with 0.16 d/D Ratio Ring | | | | | |
|---|---|---|---|---|---|
| RPM | Circulation Time | Circulation Pressure (PSI) | Pump Rate (GPM) | Debris Dropped | Debris Recovered |
| 15-20 | (5 mins to TD) 5 min circulation after reaching TD (1st trip) | 650 | 325 | 15 lbs perf. Gun debris 125 lbs sand | 109 lbs Sand and some debris |
| 15-20 | (3 mins to TD) 5 min circulation after reaching TD (2nd trip) | 700 | 350 | Same | 10 lbs steel perf. Gun debris, some sand |

During these tests, a conventional debris removal tool was also tested and compared with the tool of the present invention. Generally, the downhole debris removal tool of the present disclosure had a lower overall operating pressure. It was also observed that the tool can be reciprocated to TD several times before pulling the string out of the hole to reduce the number of trips. The flow rates recorded during the tests were based on a 1.5 inch inlet on the bottom of the tool. It was also determined that the overall jet pump size could be increased to boost performance by reducing the O.D. of the jet pump sub.

From the results of the test performed, it was determined that the smaller the d or inner diameter of the jet, the stronger the suction at the suction tube and the higher the efficiency of the jet pump. However, it was observed that an inner diameter of the jet of 0.051" or greater may result in lower suction flow velocity. In one test with a large d of 0.156" (equivalent jet diameter) (d/D=0.39), the tool almost lost the 'pump' function. It was further noted that the larger the d/D ratio, that is, the ratio of the equivalent diameter of the jet to the inner diameter of the mixing tube, the weaker the sucking force. At low flow rates, conventional and the annular jet pump had higher efficiencies (20 GPM pumping flow rate). It was observed that if the overall size of the jet pump can be increased, the efficiency of the jet pump at higher rig pump rates can be increased due to lower turbulence values and friction losses in the jet pump itself. An advantage of the annular jet pump arrangement is that it will allow for the largest possible jet pump size for a given tool outer diameter due to its unique geometry.

Advantageously, embodiments of the present disclosure provide a downhole debris removal tool that includes a jet pump device to create a vacuum to suction fluid and debris from a wellbore. Further, the downhole debris removal tool of the present disclosure produces a venturi effect with maximum efficiency at low pump rates for removing debris from, for example, FIV valves and completion equipment. Additionally, the downhole debris removal tool of the present disclosure may be used in wellbores of varying sizes. That is, the annular size, or annulus space between the casing and the tool, may be insignificant. Embodiments of the present invention provide a downhole debris removal tool that can easily be field redressed and that allows verification of removed debris on the surface. Advantageously, special chemicals do not need to be pumped with the tool and high rig flow rates are not required for optimal clean up.

Further, embodiments disclosed herein advantageously provide an isolation valve for a downhole debris removal tool. In particular, an isolation valve in accordance with embodiments disclosed herein provides selective isolation of a debris sub to allow for connections between multiple segments of a debris sub and/or connections between the debris sub and other tools or components to be broken and made up with minimal spillage or leakage of debris and fluids contained within the debris sub. An isolation valve formed in accordance with the present disclosure may provide a safer and cleaner downhole debris removal tool.

Furthermore, embodiments disclosed herein advantageously provide a downhole debris removal tool having a drain pin. The drain pin formed in accordance with the present disclosure provides selective fluid communication between the debris sub and the suction tube to allow for fluid contained in the debris sub to be selectively disposed of through the suction tube. Selective disposal of the fluids contained within the debris sub may be performed on a rig floor after the downhole debris removal tool has been removed from the wellbore. Draining fluid from the tool may provide a safer working environment by reducing the risk of fluid spillage when disassembling components of the downhole debris removal tool.

Advantageously, embodiments disclosed herein provide a downhole debris removal tool including magnets disclosed on or proximate a screen disposed in the debris sub. Magnets disposed on or proximate the screen may attract metallic debris to the magnet or magnetic surface. Collection of the metallic debris on the magnets may prevent or reduce clogging the screen. Thus, embodiments disclosed herein may provide a more efficient downhole debris removal tool.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A downhole debris removal tool comprising:
a ported sub coupled to a debris sub;
a suction tube disposed in the debris sub; and
an annular jet pump sub disposed in the ported sub and fluidly connected to the suction tube,
the annular jet pump sub comprising:
at least one opening disposed proximate a lower end of the annular jet pump sub and configured to expel a flow of fluid from a bore of the annular jet pump sub; and
an annular jet cup configured to vary a size of the at least one opening.

2. The tool of claim 1, further comprising a flow diverter disposed in the debris sub.

3. The tool of claim 2, further comprising a screen disposed in the debris sub and configured to receive a flow of fluid from the flow diverter.

4. The tool of claim 1, further comprising a bottom sub coupled to a lower end of the debris sub.

5. The tool of claim 4, further comprising a debris removal cap coupled to the bottom sub.

6. The tool of claim 1, wherein the annular jet pump sub comprises two stages.

7. The tool of claim 1, wherein the ported sub comprises a mixing tube configured to receive a flow of fluid from the annular jet pump sub and the debris sub.

8. The tool of claim 1, further comprising a diffuser disposed in the ported sub and configured to expel a flow of fluid from the mixing tube to a casing annulus.

9. The tool of claim 1, further comprising at least one magnet disposed proximate the screen.

10. The tool of claim 1, further comprising an isolation valve disposed in selective fluid communication with the debris sub.

11. The tool of claim 10, wherein the isolation valve is configured to selectively close an annular space disposed between an inner tube and a housing.

12. The tool of claim 11, wherein the isolation valve is configured to selectively close a bore disposed coaxially in the inner tube.

13. The tool of claim 1, further comprising a drain pin configured to allow selective communication between the debris sub and the suction tube.

14. A method of removing debris from a wellbore comprising:
lowering a downhole debris removal tool into the wellbore, the downhole debris removal tool comprising an annular jet pump sub, a mixing tube, a diffuser, and a suction tube;
flowing a fluid through a bore of the annular jet pump sub;
jetting the fluid from the annular jet pump sub into the mixing tube;
displacing an initially static fluid in the mixing tube through the diffuser, thereby creating a vacuum effect in the suction tube to draw a debris-laden fluid into the downhole debris removal tool; and
removing the tool downhole debris removal tool from the wellbore after a predetermined time interval.

15. The method of claim 14, further comprising actuating an isolation valve.

16. The method of 14, wherein the actuating the isolation valve comprises:
selectively actuating a gate, wherein the gate selectively closes an annular space between a housing and an inner tube of the isolation valve.

17. The method of claim 14, further comprising collecting metallic debris.

18. The method of claim 14, further comprising:
opening a drain pin after removing the downhole debris removal tool; and
releasing fluid through the suction tube.

19. The method of claim 14, further comprising flowing a suction flow of debris-laden fluid through a screen.

20. The method of claim 14, further comprising adjusting a location of an annular jet cup disposed on the annular jet pump sub to vary a jet size of the jetted fluid.

21. An isolation valve comprising:
a housing;
an inner tube disposed coaxially within the housing; and
a gate, wherein the gate is configured to selectively restrict fluid flow through an annular space between the housing and the inner tube by obstructing a portion of the annular space.

22. The isolation valve of 21, wherein the gate is configured to selectively close a bore of the inner tube.

* * * * *